US010072541B2

(12) United States Patent
Griffiths et al.

(10) Patent No.: US 10,072,541 B2
(45) Date of Patent: Sep. 11, 2018

(54) OIL PAN ASSEMBLY

(71) Applicant: GM GLOBAL TECHNOLOGY OPERATIONS LLC, Detroit, MI (US)

(72) Inventors: Leonard Barry Griffiths, Fenton, MI (US); Carl Eric Fonville, Ann Arbor, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/398,017

(22) Filed: Jan. 4, 2017

(65) Prior Publication Data

US 2018/0187581 A1 Jul. 5, 2018

(51) Int. Cl.
*F01M 11/00* (2006.01)

(52) U.S. Cl.
CPC . *F01M 11/0004* (2013.01); *F01M 2011/0054* (2013.01)

(58) Field of Classification Search
CPC .... F01M 11/004; B65D 81/261; B65D 90/24; B65D 25/22; F16N 31/002; F16N 31/006; F16N 31/004
USPC ..... 220/573, 571, 675, 669, 482, 480, 476; 184/106; 137/312; 248/311.2
See application file for complete search history.

(56) References Cited

U.S. PATENT DOCUMENTS 3,653,464 A 4/1972 Jacobsen et al.
3,980,153 A * 9/1976 Andrews ..... F16N 31/006 180/69.1
4,394,853 A * 7/1983 Lopez-Crevillen ..... F01M 11/0004 123/195 C
4,522,165 A 6/1985 Ogawa
4,667,628 A * 5/1987 Lopez-Crevillen ..... F01M 11/0004 123/195 C
4,682,672 A * 7/1987 Berger ..... F01M 11/0004 123/195 C
5,452,693 A * 9/1995 Clark ..... F01M 11/0004 123/195 C
5,531,196 A 7/1996 Clark
6,173,966 B1 * 1/2001 Noble ..... F01M 11/0004 277/591
2012/0247420 A1 * 10/2012 Griffiths ..... F16B 5/025 123/198 E (Continued)

FOREIGN PATENT DOCUMENTS

JP 2004278446 A 10/2004
KR 101190727 B1 10/2012

OTHER PUBLICATIONS

Covell, Ron. "Beading Machines for Sheetmetal Work". Hot Rod Network,http://www.hotrod.com/articles/beading-machines-for-sheetmetal-work/, Mar. 27, 2014, p. 1.*

*Primary Examiner* — Robert J Hicks

(57) ABSTRACT

An oil pan assembly for a vehicle is provided which reduces and the movement of the oil pan relative to the engine block, and reduces the mechanical strain on the Room Temperature Vulcanizing (RTV) layer between the oil pan and the engine block. The oil pan assembly includes a brace and an oil pan having a base and sidewalls, and optionally an oil pan cover. The oil pan may include a peripheral flange operatively configured to be coupled to an engine block. The brace may be affixed to the oil pan about the peripheral area of the oil pan.

5 Claims, 6 Drawing Sheets

(56) References Cited

U.S. PATENT DOCUMENTS

2014/0069940 A1* 3/2014 Griffiths ..... F01M 11/0004
220/659
2014/0091528 A1* 4/2014 Griffiths ..... F16J 15/064
277/313

* cited by examiner

OIL PAN ASSEMBLY

TECHNICAL FIELD

The invention relates generally to vehicle engines, and in particular, an oil pan arrangement used in vehicle engines.

BACKGROUND

The present invention relates in general to a new oil pan arrangement which reduces the relative movement between the engine block and the oil pan.

In a traditional oil pan arrangement for a vehicle, the oil pan is typically mounted on the engine block with an RTV layer situated in the joint between the oil pan and the engine block. The RTV layer functions to seal the joint between the oil pan and the engine block under all loading—mechanical, thermal, and dynamic loading. Therefore, the RTV layer further functions to maintain the seal between the oil pan and the engine block even where there is relative movement between the oil pan and the engine block—normal opening and lateral slip between the components due to differential thermal expansion/contraction or mechanical loads.

Bolts are typically spaced along the oil pan (proximate to the perimeter of the oil pan) in order to mount the oil pan to the engine block. However, despite the RTV layer and the use of bolts/nuts about the perimeter of the oil, a traditional oil pan still experiences movement relative to the engine block which further serves to strain the RTV layer seal between the oil pan and the engine block.

Accordingly, there is a need to reduce the relative movement between the oil pan and the engine block in order to reduce the mechanical strain on the RTV seal layer as well as to reduce the motion, vibration and noise in the vehicle.

SUMMARY

Accordingly, the present disclosure provides an oil pan arrangement for a vehicle wherein the oil pan arrangement includes an oil pan and a brace. The structure of the oil pan may further include a base, at least one sidewall, and a peripheral flange. The oil pan arrangement may also include an oil pan cover. The peripheral flange of the oil pan may be operatively configured to be coupled to an engine block. The brace may be affixed to the oil pan proximate to the peripheral edge of the oil pan.

In another embodiment of the present disclosure, the oil pan assembly may include an oil pan, a brace, and a plurality of fasteners. The oil pan may include a base, a sidewall, and a flange. The flange may be operatively configured to be coupled to an engine block. The brace may abut the flange and may be affixed to the oil pan about the periphery of the oil pan. The plurality of fasteners may fasten both the brace and the oil pan onto the engine block via a plurality of apertures defined in the oil pan and brace which are aligned to one another so that each aperture in the plurality of apertures may receive a single fastener.

The brace may include a top surface, a lower surface, an inner wall and an outer wall and may further define an enlarged opening which may receive the oil pan base and side wall. The top surface of the brace may optionally define a plurality of serrations which may engage with the peripheral flange of the oil pan. The top surface of the brace abuts the flange of the oil pan.

The oil pan assembly according to the various non-limiting example embodiments may further include a bead formed proximate to a peripheral edge of the oil pan. The bead may engage with the top surface of the brace. The bead may deform upon engagement with the top surface of the brace. The bead may or may not be a continuous bead formed proximate to the peripheral edge of the oil pan.

The top surface of the brace may optionally define a plurality of serrations which, upon engagement with the bead may cause the bead to deform according to the plurality of serrations. Alternative to the bead, or in addition to the bead, the oil pan assembly according to the various embodiments may include a plurality of constraint tabs formed proximate to a peripheral edge of the oil pan. The plurality of the constraint tabs may engage with the inner wall of the brace.

The flange in the various embodiments of the oil pan assembly may further include a vertical member disposed approximately 90 degrees relative to an engagement surface of the flange.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figure 1:
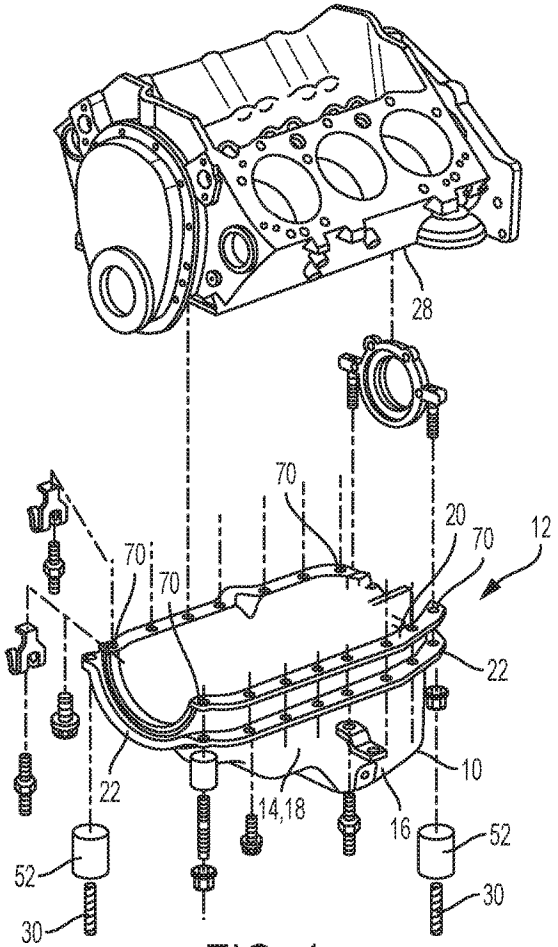
FIG. 1 is an expanded assembly view of the oil pan assembly of the present disclosure and an engine block.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any manner.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

The present disclosure provides a solution for reducing joint movement as well as vibration in the oil pan assembly for a vehicle. It is understood that joint movement may be due to mechanical and thermal loads on the engine while joint vibration may be due to dynamic excitation of the engine.

This reduction in the joint movement and vibration is achieved by providing a constraint brace 22 for the vehicle oil pan assembly wherein the constraint brace 22 is affixed to the oil pan 10. The constraint brace 22, together with the configuration of the oil pan 10, impedes the transmission of noise from the pan 10 to the enclosure through the attachment system by preventing normal and lateral movement in the joints of pan.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
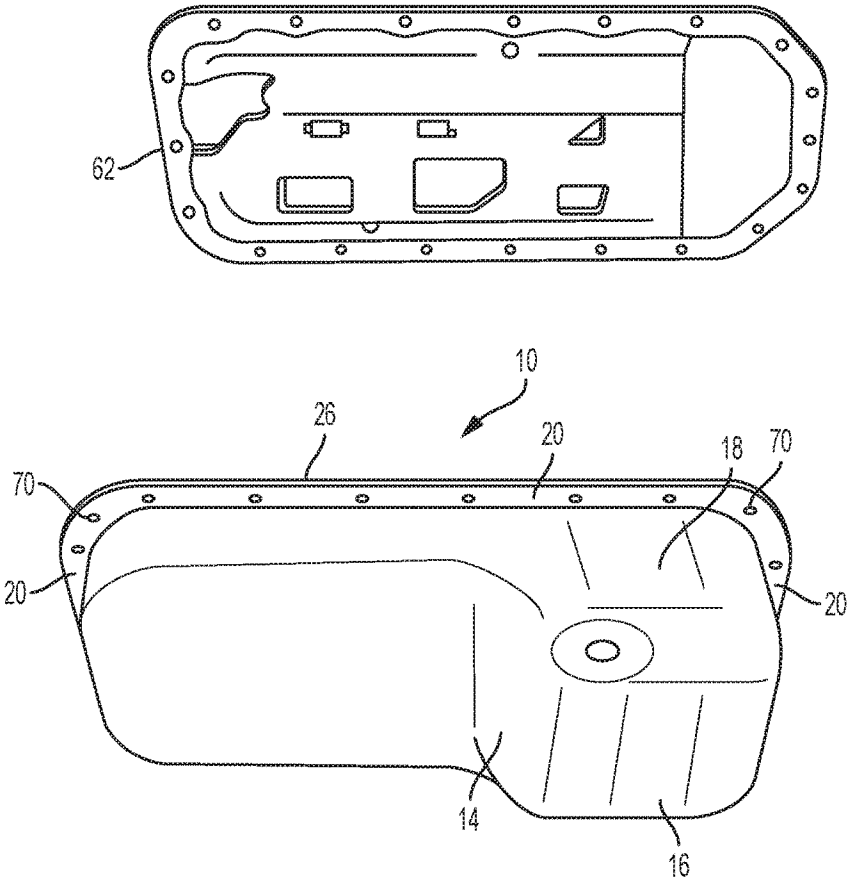
FIG. 2 is a lower side view of the oil pan of the present disclosure.
Figure 5:
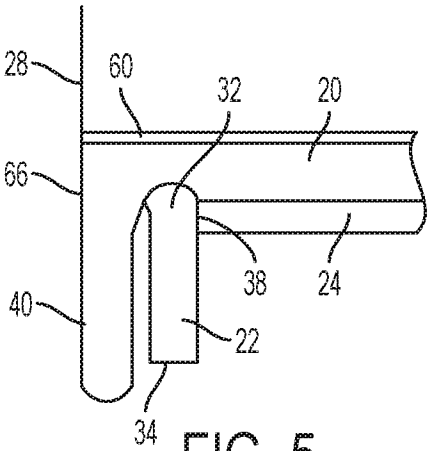
FIG. 5 is a cross sectional view of the brace and oil pan flange in accordance with a first embodiment of the present disclosure.

Referring to FIGS. 1 and 2, there is a vehicle oil pan 10 which attaches to an engine block 28 in accordance with the present invention. The vehicle oil pan 10 includes an outer, relatively rigid shell 14 including the base 16 of the oil pan 10 and all of the surrounding and enclosing sidewall portions 18. A flange 20 is formed about the peripheral edge 26 of the oil pan 10. The flange 20 may have constraint tabs 24 spaced along the perimeter of the oil pan 10 as shown in FIG. 5. The constraint tabs 24 may be formed into the oil pan 10 or the constraint tabs 24 may be affixed to the oil pan 10 cover as separate components. The constraint tabs 24 may be affixed to the oil pan 10 via a welding process or a mechanical fastener 30.

Figure 3:
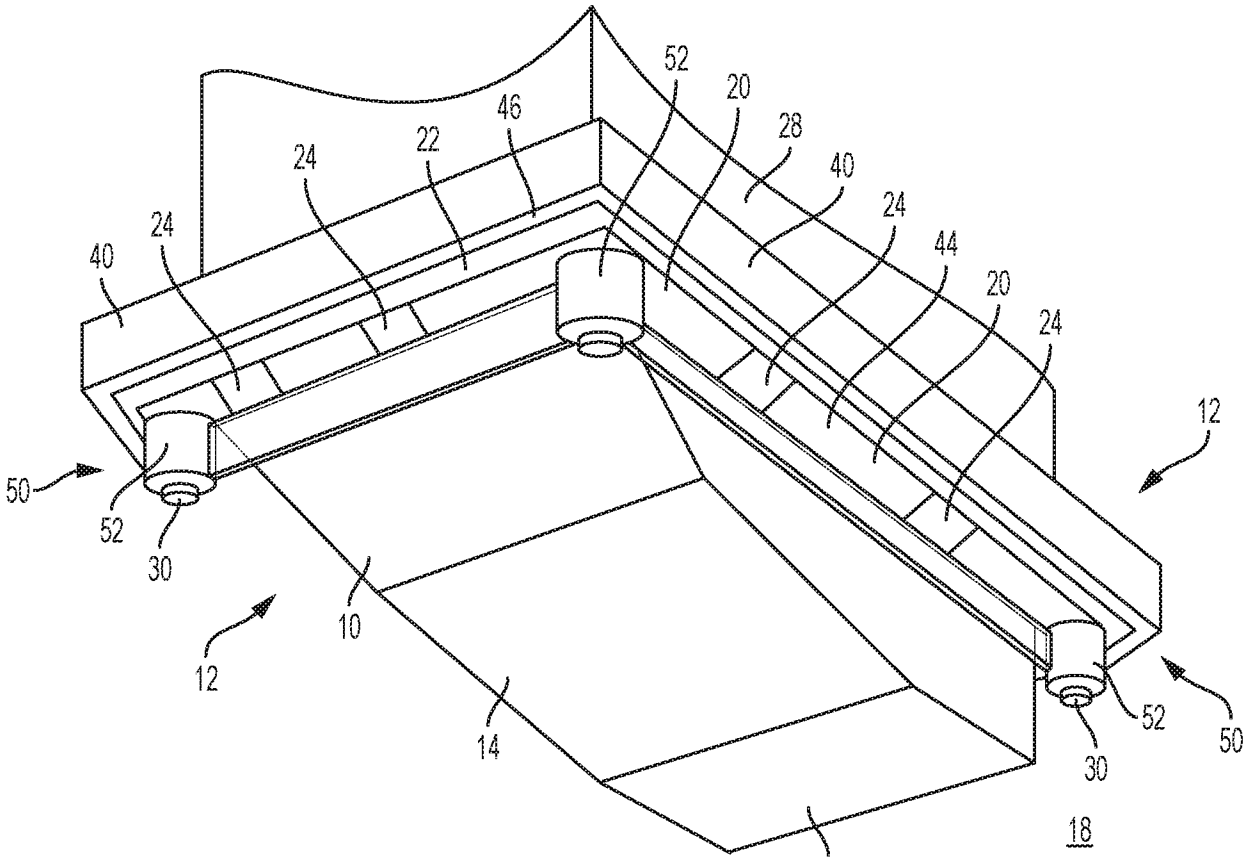
FIG. 3 is a lower isometric schematic view of an example oil pan assembly of the present disclosure installed onto an engine block.

With reference to FIG. 3, a schematic isometric image of the oil pan assembly 12 of the present disclosure is shown where the oil pan assembly 12 is installed on an engine block 28. As shown, in order to attach the oil pan 10 to the engine block 28, a brace 22 may be implemented where the brace 22 is disposed on top of the flange 20 of the oil pan 10. The brace 22 defines an enlarged opening 54 (shown in FIG. 7) which is operatively configured to accept the base 16 of the oil pan 10 and the surrounding/enclosing sidewall portions 18 of the oil pan 10 as shown in FIG. 3. The brace 22 attaches to the oil pan 10 cover proximate to the peripheral edge 26 of the oil pan 10 as shown. Mechanical fasteners 30 may be implemented to join the brace 22 and oil pan 10 to the engine block 28. The non-limiting example mechanical fasteners 30 shown in FIG. 3 are clamp bolts 30 and bosses 52 used in the four corners of the brace 22 arrangement. It is understood that a variety of mechanical fasteners 30 or fastening systems may be implemented to join the brace 22 and oil pan 10 to the engine block 28.

Figure 6:
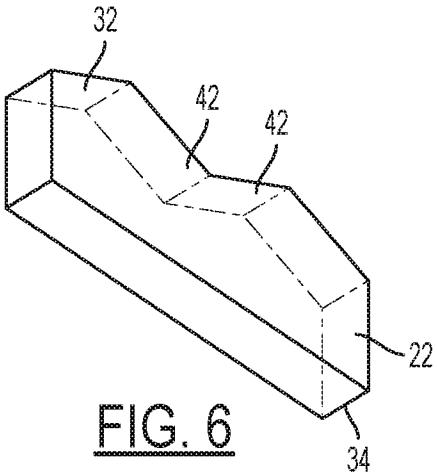
FIG. 6 is a cross sectional view of the brace and oil pan flange in accordance with a second embodiment of the present disclosure.
Figure 4:
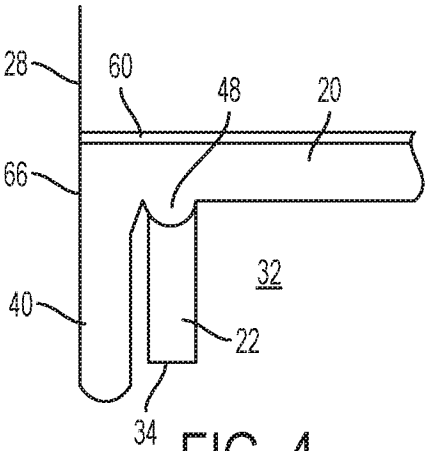
FIG. 4 is a partial schematic isometric view of an example brace in accordance with various embodiments of the present disclosure.
Figure 7:
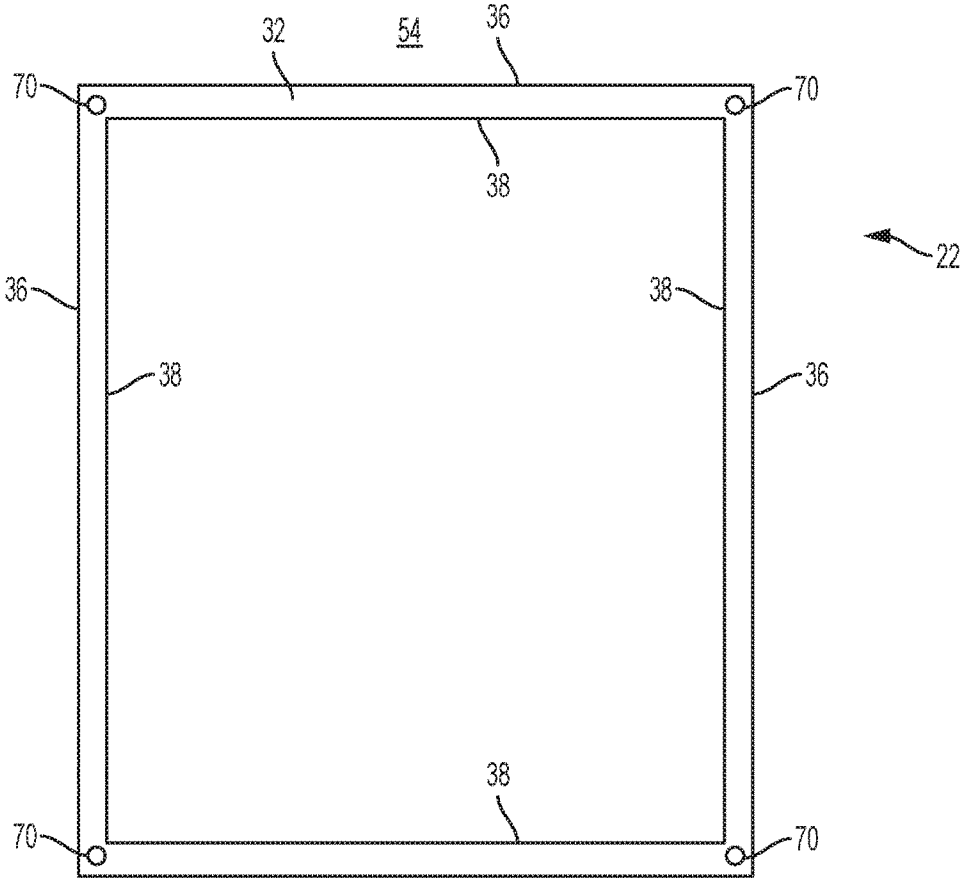
FIG. 7 is a top view of an example brace in accordance with various embodiments of the present disclosure.
Figure 8:
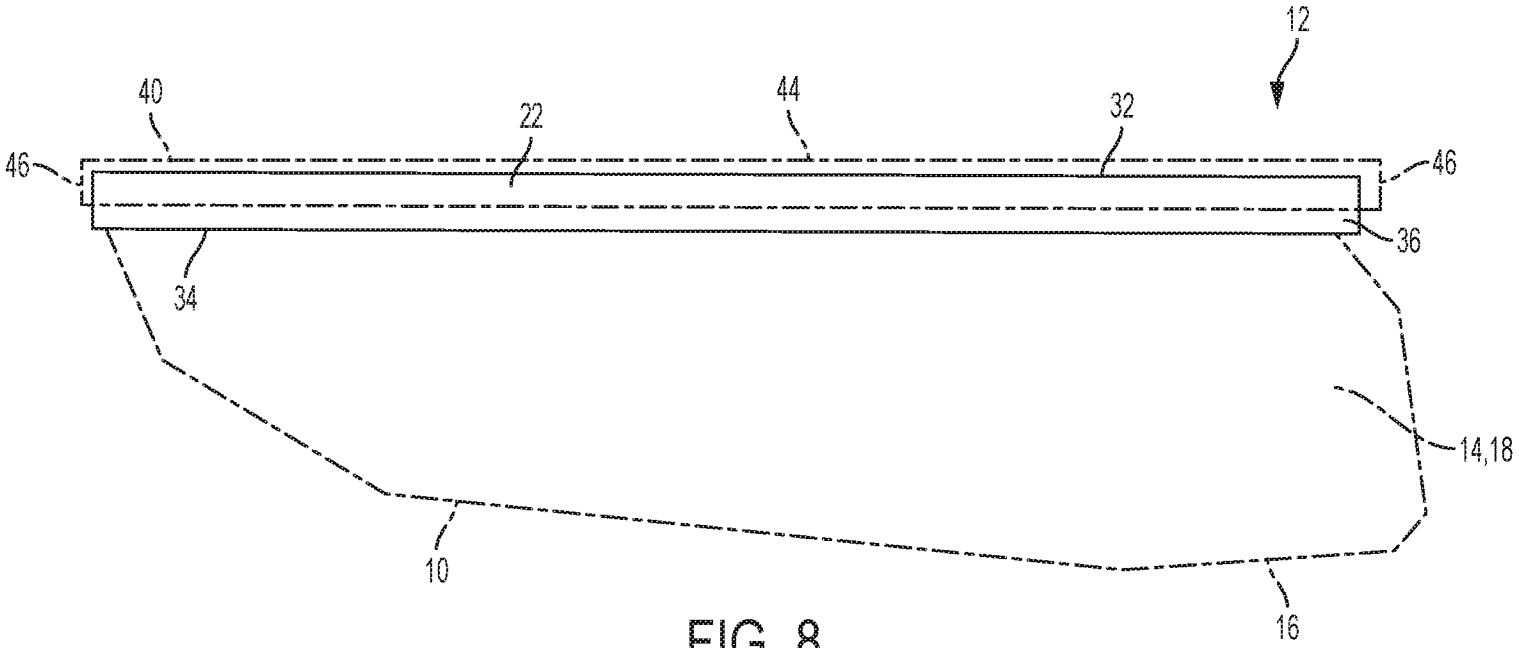
FIG. 8 is a side view of the oil pan assembly of the present disclosure where the oil pan is in phantom and the brace is in solid.

With reference to FIG. 7, a top view of an example brace 22 is shown. The non-limiting example brace 22 includes four sides as shown. However, it is understood that the brace 22 of the present disclosure is not limited to the four sides shown in FIG. 7. The enlarged opening 54 defined in the brace 22 is configured to accept the base 16 and side walls 18 of the oil pan 10. With reference to FIGS. 4-6, the brace 22 may include a top surface 32, a lower surface 34, an outer wall 36 and an inner wall 38. The top surface 32 of the brace 22 is designed to abut the flange 20 of the oil pan 10. The oil pan flange 20 may optionally include a vertical member 40 integral to the flange 20 as shown in FIGS. 5 and 6. The vertical member 40, the flange 20, the oil pan base 16 and the oil pan sidewall 18 may be formed from a single component via a stamping or casting process or the like. It is further understood that the top surface 32 of the brace 22 may optionally define serrations across the entire top surface 32 so as to allow the brace 22 to engage into flange 20 of the oil pan 10. The engagement between the serrated top surface 32 of the brace 22 and the flange 20 further prevents excessive oil pan 10 movement relative to the engine block 28.

Additionally, as shown in FIGS. 4 and 5, example cross sections of flange 20' configurations are provided where the flange 20' is engaged with the brace 22 and an engine block 28 with RTV Sealant 60 between the flange 20' and the engine block 28'. The flange shown as 20' in FIGS. 4 and 5 may be the flange 20' in the oil pan 10 or may be a flange 20' formed in the oil pan cover 62. Flange 20' may define or include a constraint tab 24 (shown in FIG. 5) or bead 48 (shown in FIG. 4) which runs proximate to the peripheral edge 66 of either the oil pan 10 or cover 62. The tab 24 or bead 48 each further enable the oil pan 10 to be securely attached to the engine block 28 and to further reduce movement of the oil pan 10 relative to the engine block 28. Where a constraint tab 24 is implemented, the brace 22 is adjacent to and abuts both the oil pan flange 20 and the constraint tab 24. At least a portion of the inner wall 38 may abut the constraint tab 24. This joint 50 between the inner wall 38 of the brace 22 and the constraint tab 24 prevents lateral and longitudinal movement of the oil pan 10 relative to the engine block. As indicated earlier, the tabs 24 may be spaced along the entire periphery of the oil pan 10 including the lateral and longitudinal edges 44, 46 of the oil pan 10.

The oil pan 10 may alternatively (or additionally) include a raised bead 48 as shown in FIG. 4 where the bead 48 runs proximate to the periphery of the oil pan 10. When the brace 22 is assembled onto the flange 20 of the oil pan 10, the bead 48 formed in the oil pan flange 20 may engage with the top surface 32 of the brace 22. Again, the top surface 32 of the brace 22 may or may not have a serrations 42 formed in the top surface 32. However, where serrations 42 are formed in the top surface 32, those serrations 42 engage with the bead 48 and may be even deform the bead 48 in certain areas. As a result of this deformation in the flange 20 when the parts are joined, the oil pan 10 is further secured to the brace 22 and the engine block 28 thereby preventing movement of the oil pan 10 relative to the engine block 28.

With reference again to FIG. 4, the serrations 42 shown are simply one example. It is understood that the serrations 42 may be provided in a variety of configurations in the top surface 32 or other surfaces of the brace 22. The serrations 42 of the present disclosure are configured to engage with the flange 20 of the oil pan 10 cover upon assembly so as to further prevent movement in the oil pan 10.

Accordingly, the present disclosure provides an oil pan assembly 12 for a vehicle includes an oil pan 10 and a brace 22. The oil pan 10 may further include an a base 16, at least one sidewall 18, and a peripheral flange 20. The peripheral flange 20 may be operatively configured to be coupled to an engine block 20. The brace 22 may be affixed to the oil pan 10 proximate to the periphery of the oil pan 10 at flange 20' in the oil pan. Alternatively the brace 22 may be affixed to the cover 62 at a flange 20' formed proximate to the edge of the cover 62.

It is understood that the present disclosure contemplates an embodiment where an oil pan assembly may include an oil pan, a brace, and a plurality of fasteners. The oil pan may include a base 16, a sidewall 18, and a flange 20. The flange 20 may be operatively configured to be coupled to an engine block. The brace 22 may be affixed to the oil pan 10 proximate to the peripheral edge 26 of the oil pan 10. A plurality of fasteners 30 may fasten both the brace 22 and the oil pan 10 (and/or the cover 62) onto the engine block 28 via a plurality of apertures 70 defined in the oil pan 10 (or cover 62) and brace 22 which are aligned to one another so as each aperture 70 in the plurality of apertures 70 may receive a single fastener 30.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An oil pan assembly for a vehicle engine comprising:
an oil pan having a base, a sidewall, and a peripheral flange defining a continuous bead integral to the peripheral flange of the oil pan, the oil pan being operatively configured to be coupled to an engine block; and
a brace affixed to the oil pan about the periphery of the oil pan, the brace having a lower surface, an inner wall, an outer wall, and a top surface with a plurality of serrations engaging with and deforming the continuous bead;
wherein the oil pan is configured to deform upon engagement with the brace at the bead.

2. The oil pan assembly of claim 1 wherein the oil pan defines a plurality of constraint tabs formed proximate to a peripheral edge of the oil pan, the plurality of constraint tabs being operatively configured to engage with the inner wall of the brace.

3. The oil pan assembly of claim 1 wherein the peripheral flange defines a vertical member disposed approximately 90 degrees relative to an engagement surface of the flange.

4. The oil pan assembly of claim 1 wherein the bead is operatively configured to engage with the top surface of the brace.

5. The oil pan assembly of claim 4 wherein the bead is a continuous bead formed proximate to the peripheral edge of the oil pan and is operatively configured to deform upon engagement with the plurality of serrations.

* * * * *